US008297406B2

(12) United States Patent
Yeh

(10) Patent No.: US 8,297,406 B2
(45) Date of Patent: Oct. 30, 2012

(54) DEVICE CAPABLE OF EXTENDING A FOOT END OF A LADDER

(75) Inventor: Tom Yeh, Keelung (TW)

(73) Assignee: Dofair Co., Ltd., Keelung (TW)

( * ) Notice: Subject to any disclaimer, the term of this patent is extended or adjusted under 35 U.S.C. 154(b) by 126 days.

(21) Appl. No.: 13/032,793

(22) Filed: Feb. 23, 2011

(65) Prior Publication Data

US 2011/0214946 A1 Sep. 8, 2011

(30) Foreign Application Priority Data

Mar. 3, 2010 (TW) ..... 99203769 U

(51) Int. Cl.
*E06C 7/00* (2006.01)

(52) U.S. Cl. ..... 182/205; 182/201

(58) Field of Classification Search ..... 182/201, 182/204, 205

See application file for complete search history.

(56) References Cited

U.S. PATENT DOCUMENTS 1,611,057 A * 12/1926 Neil ..... 182/205
1,761,173 A * 6/1930 Bluemel ..... 165/82
2,127,884 A * 8/1938 Overpeck ..... 182/205
2,152,895 A * 4/1939 Longtin ..... 182/205
3,882,966 A * 5/1975 Fasano ..... 182/205
4,014,406 A * 3/1977 Easton ..... 182/204
5,678,656 A * 10/1997 Lanzafame ..... 182/205
6,234,273 B1 * 5/2001 Moore ..... 182/204
6,450,292 B1 * 9/2002 Sheffield ..... 182/205
6,478,113 B1 * 11/2002 Ellison ..... 182/204
6,640,932 B1 * 11/2003 Weatherall ..... 182/204
7,222,695 B2 * 5/2007 Jules et al. ..... 182/200

* cited by examiner

*Primary Examiner* — Alvin Chin Shue

(57) ABSTRACT

A device capable of extending a foot end of a ladder includes a box tube section with an elongated hole, a long engaging plate with an elongated hole and a plurality of inserting teeth, a short engaging plate with a central fixing hole, two pairs of engaging slots and an engaging nut, and a knob head bolt. The knob head bolt passes through the elongated holes, and the central fixing hole to be tightened to the engaging bolt via a rail of the ladder. The long and short engaging plates are disposed in the box tube section to face to each other. The knob head bolt is loosened or tightened to cause two pairs of the inserting teeth disengaging or inserting into the engaging slots for the box tube section being operated to extend a distance outward the rail stably and safely.

8 Claims, 4 Drawing Sheets

DEVICE CAPABLE OF EXTENDING A FOOT END OF A LADDER

FIELD OF THE INVENTION

The present invention relates to a device capable of extending a foot end of a ladder, and particularly to a device which is capable of operated to extend the foot end outward a rail of the ladder a distance with respect to different elevations of the ground.

BACKGROUND OF THE INVENTION

Normally, the conventional ladder is designed for standing on an even ground. However, it is frequent that an uneven ground such as steps of a stair or slope land is met while the ladder is in use. As a result, the conventional ladder becomes lacking stability to impair personal safety of the user.

U.S. Pat. No. 5,074,377, which is corresponding to German Patent Application No. G8814195), discloses a jointed ladder with a locking mechanism for the ladder being adjusted to different operation heights. The reference proposes a pressure plate (28) with a slotted hole (33) and a bolt (27) with a knob (30) (FIG. 6); the extension stay (16) can be moved relative to the pressure plate (28) or fixed at a desired place by means of loosening or tightening the bolt (27). A friction force between the pressure plate (28) and the extension stay (16) plays an important role to keep the extension stay in place in addition to the fastening force of the bolt (27). However, to hold the extension stay with the friction force has a deficiency of slipping out and it is an unreliable structure.

SUMMARY OF THE INVENTION

An object of the present invention is to provide a device capable of extending a foot end of a ladder which have inserting teeth and engaging slots to perform an engagement or disengagement of the inserting teeth and engaging slots for securing extension of the foot end without a deficiency of slipping out.

In order to achieve the preceding object, the device capable of extending a foot end of a ladder according to the present invention comprises a box tube section, a U-shaped long engaging plate, a U-shaped short engaging plate, and a knob head bolt; the box tube section is slidably received in a rail of the ladder with a first elongated hole disposed at a large side thereof; the long engaging plate is received and attached to the box tube section with a second elongated hole disposed at the large side thereof corresponding to the first elongated hole, a plurality of inserting teeth being disposed at the two lateral sides thereof; the short engaging plate is received in the box tube section facing the long engaging plate with a fixing hole disposed at the center of a large side thereof, two engaging slots disposed near two short lateral sides thereof respectively to space apart from each other, and an engaging nut disposed next to the central fixing hole; the knob head bolt passes through the elongated holes and the central fixing hole to engage with the engaging nut; when the knob head bolt is loosened to allow the inserting teeth disengaging from the engaging slots, the box tube section is capable of being pulled downward or push upward to adjust the box tube section extending outward the rail a distance; when the knob head bolt is tightened to allow the insert teeth engaging with the engaging slots, the box tube section with the foot pad is incapable of being moved to secure the extended box tube section in place.

BRIEF DESCRIPTION OF THE DRAWINGS

The present invention can be more fully understood by reference to the following description and accompanying drawings, in which.

DETAILED DESCRIPTION OF THE INVENTION

Figure 1:
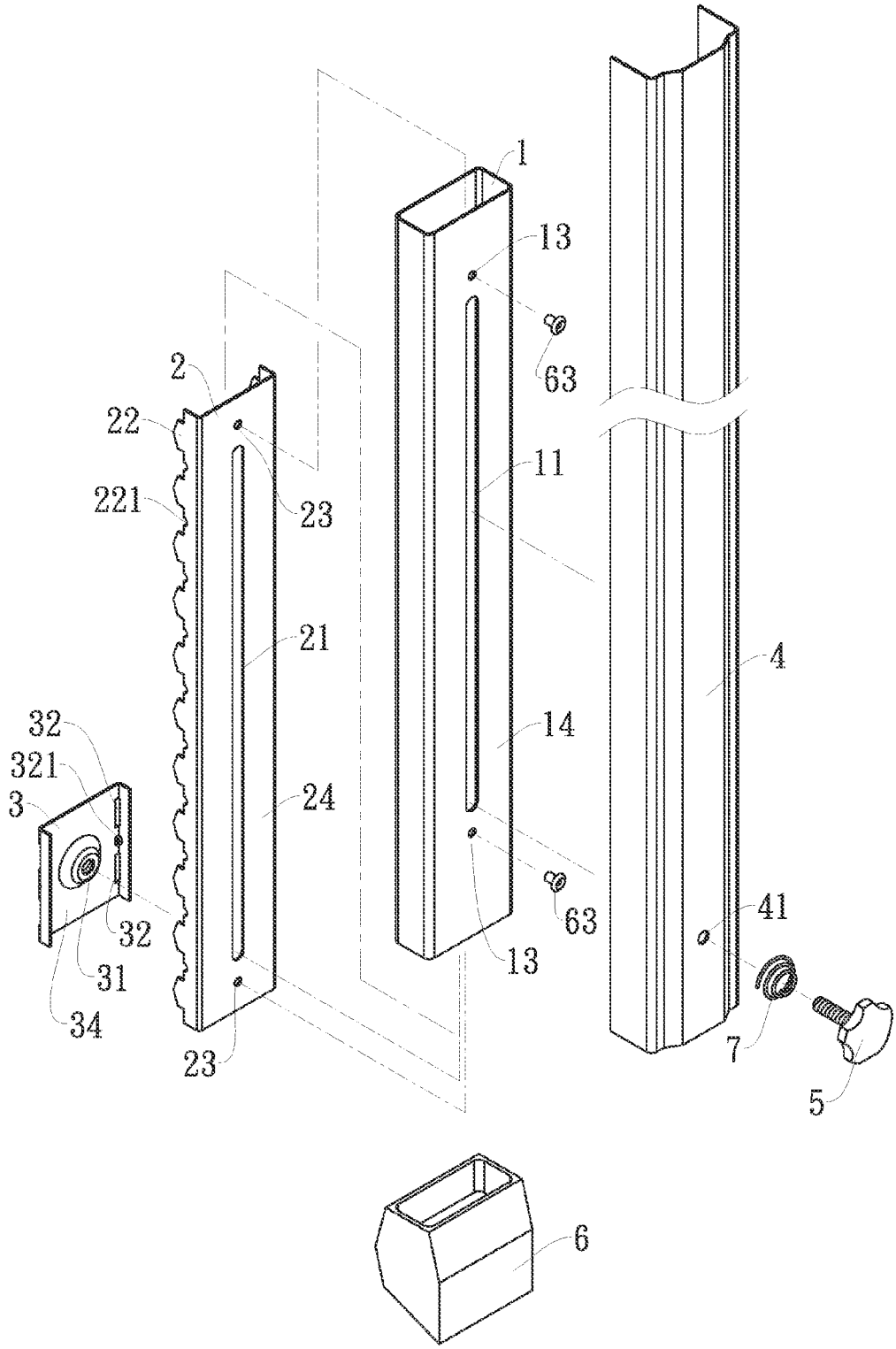
FIG. 1 is an exploded perspective view of a foot end adjustable device for a ladder according to the present invention.

Referring to FIG. 1, a device capable of extending a foot end of a ladder according to the present invention basically comprises a box tube section (1), an long engaging plate (2), and a short engaging plate (3); the box tube section (1) has a length shorter than a channel-shaped rail (4) of a ladder. One large side (14) of the box tube section (1) is provided with an elongated locating hole (11) extending along the middle thereof longitudinally, and has a rivet hole (13) is disposed next to two ends of the elongated locating hole (11) respectively. The U-shaped long engaging plate (2) has a length shorter than the box tube section (1); a large side (24) of the long engaging plate (2) is provided with an elongated hole (21) extending along the middle thereof longitudinally to correspond to the elongated hole (11) of the box tube section (1); a rivet hole (23) is disposed next to two ends of the elongated hole (21) respectively to correspond to the rivet hole (13) of the box tube section (1); two opposite lateral sides of the long engaging plate (2) have a plurality of arrow-shaped inserting teeth (22) respectively with an equal pitch; Further, a small recess (221) is disposed between every two neighboring inserting teeth (22). The long engaging plate (2) is placed in the box tube section (1) with the large side (24) thereof being disposed against the inner surface of the large side (14) of the box tube section (1) and the elongated hole (21) and the two rivet holes (23) aligning with the elongated hole (11) and the two rivet holes (13) respectively such that the long engaging plate (2) is capable of being secured to the box tube section (1) with rivets. The U-shaped short engaging plate (3) has a large side (34) being provided with a fixing hole (31) at the center thereof and an engaging nut (33) attached to the outer surface of the large side (34) in a way of the inner hole of the engaging nut (33) aligning with the central fixing hole (31) next to it (See FIGS. 2 and 3); it is noted that the short engaging plate (3) has a central recess at the central through hole for receiving the nut (33). Further, two lateral ends of the large side (34) are provided with two engaging slots (32) respectively next to opposite lateral sides of the short engaging plate (3) with a small projection (321) being disposed between the two engaging slots (32) to correspond to the inserting teeth (22) and the small recess (221) respectively for two pairs of the inserting teeth (22) inserting through the engaging holes (32) and the small projection (321) fitting with the small recess (221). The short engaging plate (3) is placed in the box tube section (1) facing the long engaging plate (2) and positioned about right above the lower ends of the elongated locating holes (11, 21).

Referring to FIG. 1 again, the rail (4) of the ladder is channel shape for accommodating the box tube section (1)

and allowing the box tube section (1) capable of slidably moving in the rail (4); the rail (4) has a through hole (41) at the lower end thereof corresponding to the central fixing hole (31) of the short engaging plate (3). A knob head bolt (5) is utilized to pass through the through hole (41), the elongated holes (11, 21) and the central fixing hole (31) and engage with the engaging nut (33) next to the central through hole (31). A cone shaped spring (7) is arranged between the knob head bolt (5) and the rail (4) to provide a cushioning effect at the time of the knob head bolt (5) being tightened to the engaging nut (33) and secure a tight engagement for the long engaging plate (2) and the short engaging plate (3). Besides, a foot pad (6) is fixedly sleeved to an end of the box tube section (1). When the box tube section (1) is positioned at an upper limit position without being pulled downward, the lower ends of the elongated holes (11, 21) are corresponding to the central fixing hole (31) and the through hole (41), and the foot pad (6) is disposed near the lower end of the rail (4); when the box tube section (1) is pulled downward to a lower limit position, the upper ends of the elongated holes (11, 21) are corresponding to the central fixing hole (31) and the through hole (41).

Figure 2:
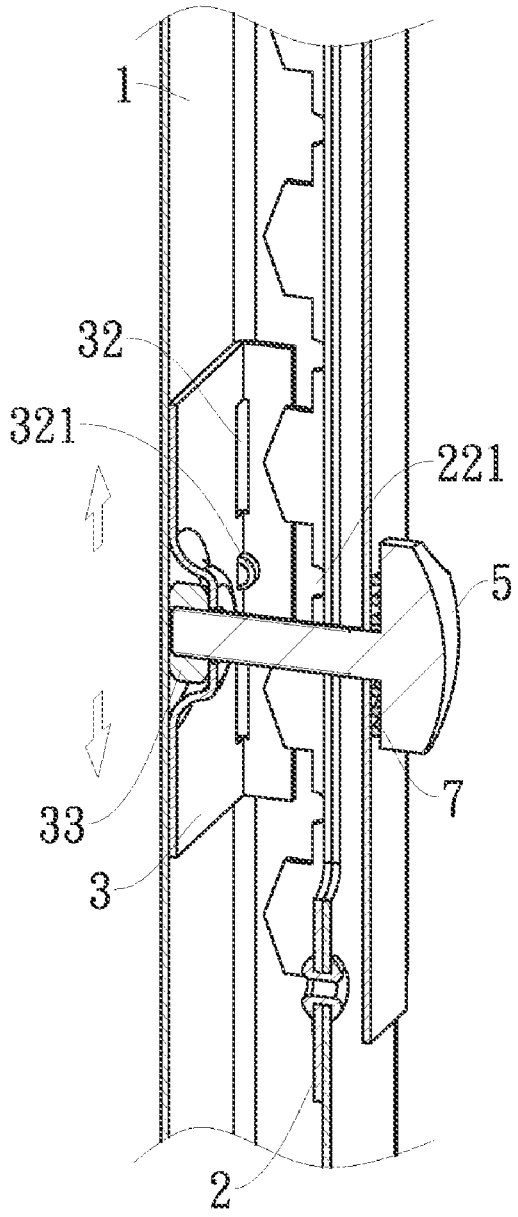
FIG. 2 is a perspective sectional view of the foot end adjustable device for a ladder illustrating that the foot end adjustable device is in a state of unlocking.

Referring to FIG. 2, after the box tube section (1), the long engaging plate (2) and the short engaging plate (3) being assembled and before the long engaging plate (2) and the short engaging plate (3) engaging with each other, the knob head bolt (5) is in a state of loosening, and the cone-shaped spring (7) is not compressed completely, the box tube section (1) can be pulled downward in case of the box tube section (1) being not at the lower limit position, and pushed upward in case of the box tube section (1) being not at the upper limit position. Two arrows directing upward and downward respectively shown in FIG. 2 indicate that the box tube section (1) can move either upward or downward.

Figure 3:
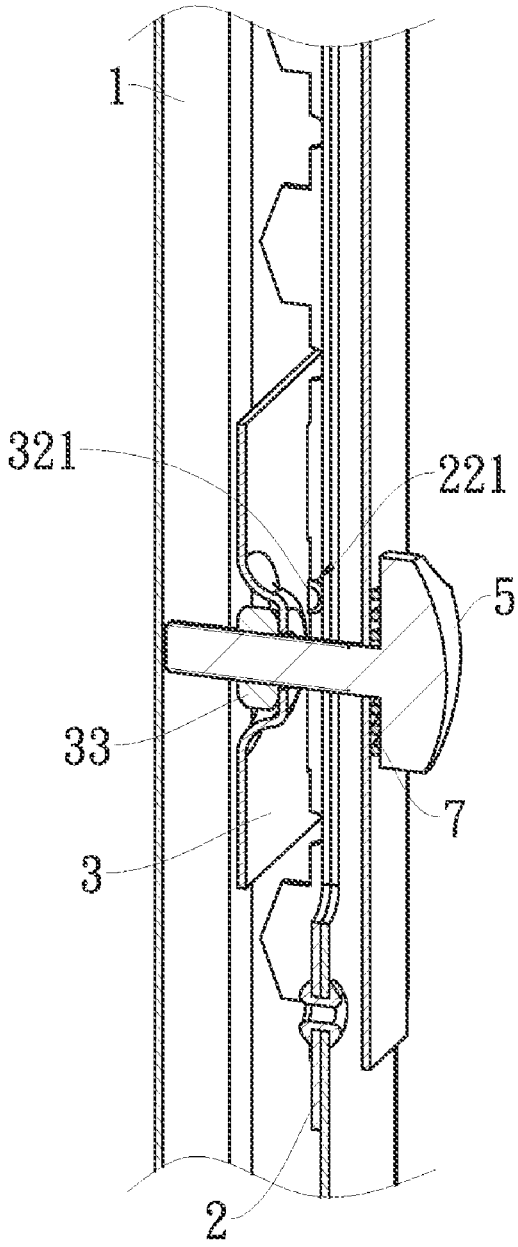
FIG. 3 is a perspective sectional view of the foot end adjustable device for a ladder illustrating that the foot end adjustable device is in a state of locking.

Referring to FIG. 3, it can be seen that two neighboring ones of the inserting teeth (22) at two lateral sides of the long engaging plate (2) have inserted through the two engaging slots (32) at two lateral sides of the large side (34) of the short engaging plate (3), and the respective small projection (321) between the two engaging slots (32) contact the respective small recess (221) between the neighboring engaging teeth (22) to constitute a steady engagement; at this time, the knob head bolt (5) is in a state of being tightened, the cone-shaped spring (7) is in state of being compressed completely, and the box tube section (1) is fixed in place without moving upward and downward.

Figure 4:
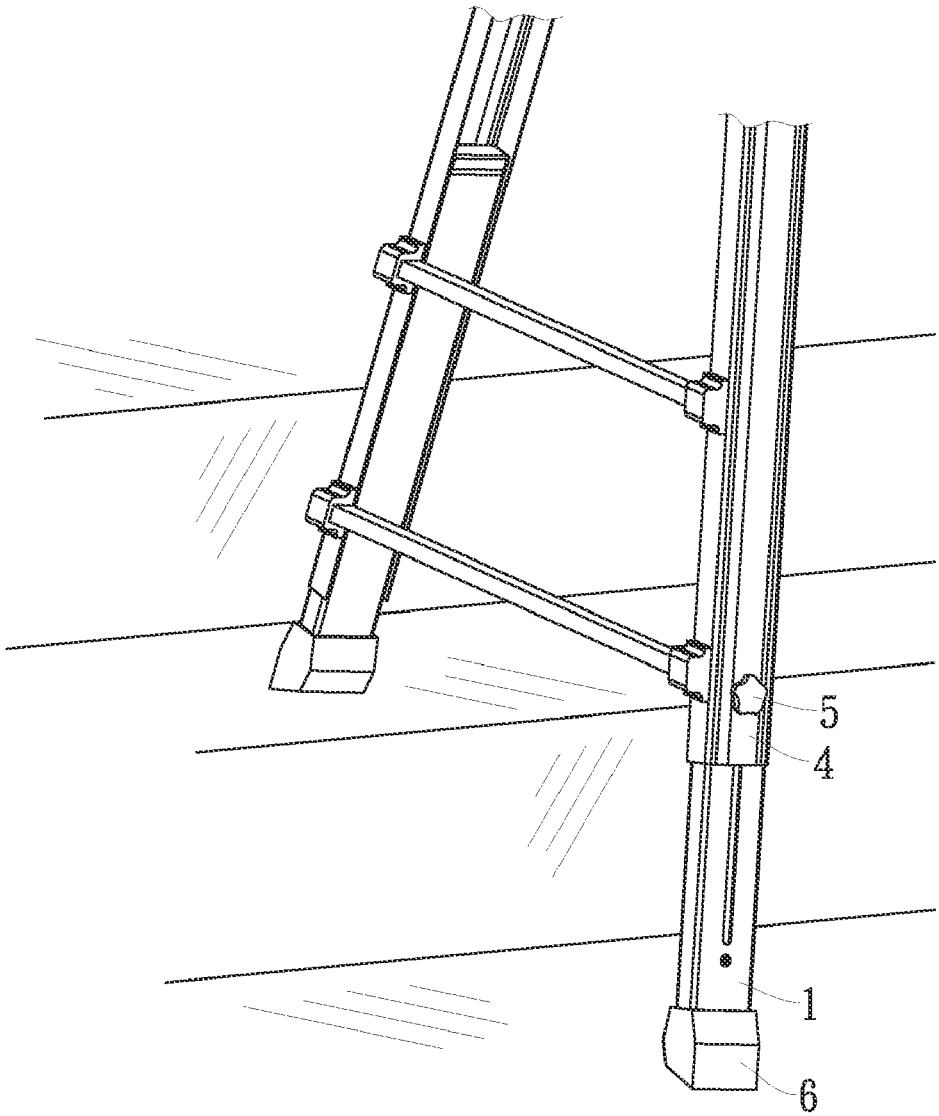
FIG. 4 is a perspective view illustrating an example of a ladder with the foot end adjustable device according to the present invention being used at steps of a stair.

Referring to FIG. 4, it is to illustrate an example of the device capable of extending a foot end of the ladder according to the present invention being used at two steps of a stair; the device allows the two foot ends of the ladder to be properly adjusted and extended in favor of the work safety. It can be seen that the box tube section (1) slidably received in the rail (4) is extended to allow one of the foot pads (6) standing on the lower one of the two steps of the stair and the other one foot pad standing on the higher one of the two steps of the stair. The knob head bolt (5) can be loosened or tightened for the device being operated to extend or secure the box tube section (1). It can be seen in FIG. 4 that two rails of the ladder are provided the device of the present invention respectively.

It is appreciated that the device capable of extending a foot end of a ladder according to the present invention provides a two engaging plates facing each other with a knob head bolt passing through the two engaging plates; when the knob head bolt is tightened or loosened, the two engaging plates engage with or disengage from each other for a box tube section with a foot pad in a rail of the ladder being extended to allow the ladder being used on a ground with different elevations.

While the invention has been described with reference to the preferred embodiments thereof, it is to be understood that modifications or variations may be easily made without departing from the spirit of this invention defined by the appended claims.

What is claimed is:

1. A device capable of extending a foot end of a ladder comprising:

a box tube section being slidably received in a channel shaped rail of the ladder, having a large side with a first elongated hole disposed at the middle of said large side, and an end extending outside the rail and being provided with a foot pad, wherein the rail is provided a through hole;

a U-shaped long engaging plate being slightly shorter than, received in and fixedly attached to the box tube section, and having a large side with a second elongated hole disposed at the middle thereof corresponding to the first elongated locating hole and two opposite lateral sides disposed with a plurality of inserting teeth with an equal pitch respectively;

a U-shaped short engaging plate being received in the box tube section to face the long engaging plate, having a large side and two lateral sides, wherein the large side has a fixing hole at the center thereof corresponding to the through hole, two engaging slots next to the two lateral sides respectively to correspond to the inserting teeth, an engaging nut disposed next to and aligning with both the central fixing hole and the through hole;

a knob head bolt adapted to pass through the first and second elongated holes and the central fixing hole and engaging with the nut via the through hole;

whereby, when the knob head bolt is loosened to allow the inserting teeth disengaging from the engaging slots, the box tube section with the foot pad is capable of being pulled downward or pushed upward to adjust the box tube section a distance extending outward the rail; when the knob head bolt is tightened to allow the inserting teeth engaging with the engaging slots, the box tube section with the foot pad is incapable of being moved to secure the box tube section in a specific place.

2. The device capable of extending a foot end of a ladder as defined in claim 1, wherein a space between the two engaging slots has a small projection, and a space between every two neighboring inserting teeth has a small recess corresponding to the small projection for the small projection contacting with the small recess at the time of the two engaging slots engaging with the two neighboring insert teeth to ensure a steady engagement.

3. The device capable of extending a foot end of a ladder as defined in claim 1, wherein a spring, preferably a cone shaped spring, is arranged between the knob head bolt and the rail to provide a cushion effect and enhance a tightening force for the knob head bolt.

4. The device capable of extending a foot end of a ladder as defined in claim 2, wherein a spring, preferably a cone shaped spring, is arranged between the knob head bolt and the rail to provide a cushion effect and enhance a tightening force for the knob head bolt.

5. A ladder comprising:

two channel shaped rails with a foot end provided at an end of the respective rail;

a device capable of extending the foot end being slidably received in the rails respectfully;

wherein the device further comprises:

a box tube section having a large side with a first elongated hole disposed at the middle of said large side, and an end extending outside the rail and being provided with a foot pad, wherein the rail is provided a through hole;

a U-shaped long engaging plate being slightly shorter than, received in and fixedly attached to the box tube section, and having a large side with a second elongated hole disposed at the middle thereof corresponding to the first elongated locating hole and two opposite lateral sides disposed with a plurality of inserting teeth with an equal pitch respectively;

a U-shaped short engaging plate being received in the box tube section to face the long engaging plate, having a large side and two lateral sides, wherein the large side has a fixing hole at the center thereof corresponding to the through hole, two engaging slots next to the two lateral sides respectively to correspond to the inserting teeth, an engaging nut disposed next to and aligning with both the central fixing hole and the through hole;

a knob head bolt adapted to pass through the first and second elongated holes and the central fixing hole and engaging with the nut via the through hole;

whereby, when the knob head bolt is loosened to allow the inserting teeth disengaging from the engaging slots, the box tube section with the foot pad is capable of being pulled downward or pushed upward to adjust the box tube section a distance extending outward the rail; when the knob head bolt is tightened to allow the inserting teeth engaging with the engaging slots, the box tube section with the foot pad is incapable of being moved to secure the box tube section in a specific place.

6. The ladder as defined in claim 5, wherein a space between the two engaging slots has a small projection, and a space between every two neighboring inserting teeth has a small recess corresponding to the small projection for the small projection contacting with the small recess at the time of the two engaging slots engaging with the two neighboring insert teeth to ensure a steady engagement.

7. The ladder as defined in claim 5, wherein a spring, which is preferably a cone shaped spring, is arranged between the knob head bolt and the rail to provide a cushion effect and enhance a tightening force for the knob head bolt.

8. The ladder as defined in claim 6, wherein a spring, which is preferably a cone shaped spring, is arranged between the knob head bolt and the rail to provide a cushion effect and enhance a tightening force for the knob head bolt.

* * * * *